United States Patent [19]

McFadyen et al.

[11] Patent Number: 4,756,037

[45] Date of Patent: Jul. 12, 1988

[54] CONTINUOUS GARMENT DYEING WITH INDIGO AND OTHER VAT DYES

[75] Inventors: George McFadyen, Raleigh; Rob Stone, Cary; Glenn Morton, Apex, all of N.C.

[73] Assignee: Cotton Incorporated, New York, N.Y.

[21] Appl. No.: 854,873

[22] Filed: Apr. 23, 1986

[51] Int. Cl.[4] ..... D06B 3/30

[52] U.S. Cl. ..... 8/150; 8/150.5; 8/653

[58] Field of Search ..... 68/157, 158, 4, 11, 68/10; 8/150, 150.5, 503, 650, 653, 149.1

[56] References Cited

U.S. PATENT DOCUMENTS

| | | | |
|---|---|---|---|
| 810,394 | 1/1906 | Cleff | 8/150 X |
| 1,873,004 | 8/1932 | Meinig | 8/150 |
| 2,450,773 | 10/1948 | Weber | 8/653 X |
| 3,047,352 | 7/1962 | Santoro et al. | 8/653 X |
| 3,576,589 | 4/1971 | Coon | 8/650 X |
| 3,938,952 | 2/1976 | McNeill | 8/150 |
| 4,166,717 | 9/1979 | Fono et al. | 8/653 |
| 4,283,194 | 8/1981 | Teague et al. | 8/653 X |
| 4,310,332 | 1/1982 | Curzons | 8/650 X |
| 4,365,373 | 12/1982 | Witte et al. | 8/150 |
| 4,371,373 | 2/1983 | Balland | 8/650 |

FOREIGN PATENT DOCUMENTS

| | | | |
|---|---|---|---|
| 1098258 | 3/1981 | Canada | 8/653 |
| 567839 | 1/1933 | Fed. Rep. of Germany | 8/150 |
| 1920442 | 1/1971 | Fed. Rep. of Germany | 8/150 |
| 732993 | 7/1955 | United Kingdom | 8/150 |

*Primary Examiner*—Harvey C. Hornsby
*Assistant Examiner*—Frankie L. Stinson
*Attorney, Agent, or Firm*—Burns, Doane, Swecker & Mathis

[57] ABSTRACT

The present invention provides a process for the rapid room temperature dyeing of a series of successive garments with a vat dye, preferably indigo dye, wherein the garments while supported on supports that keep all fabric surfaces of each garment accessible to treating solutions are first uniformly impregnated with the dye solution in a first bath and then immersed in an oxidizing solution in a second bath so as to uniformly oxidize the dye present in the garments.

21 Claims, 2 Drawing Sheets

FIG. 1
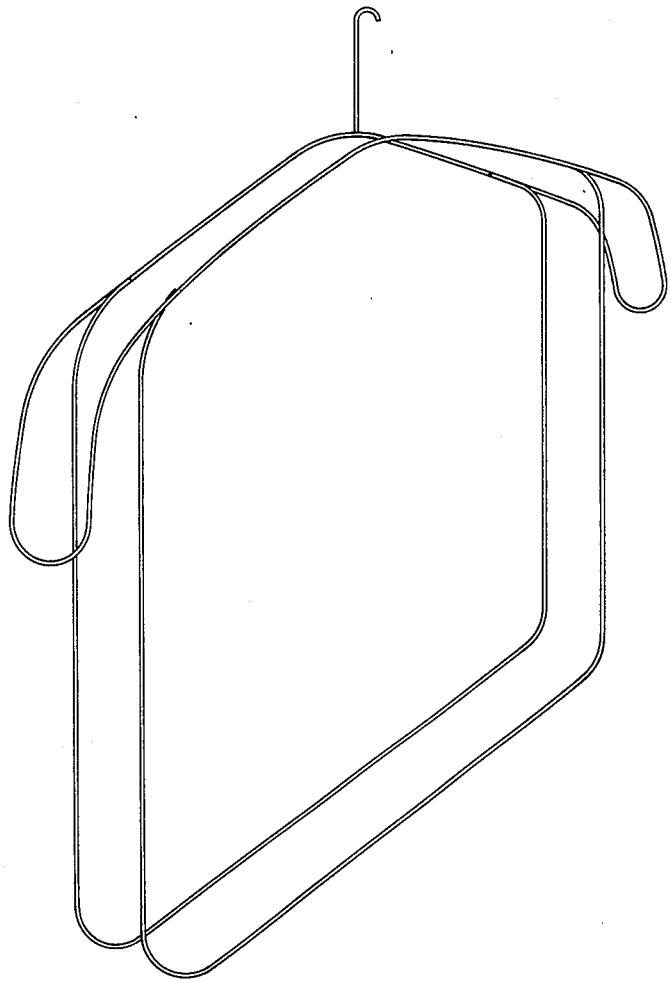
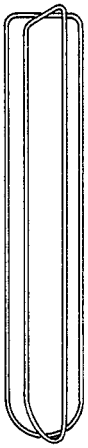
FIG. 3

CONTINUOUS GARMENT DYEING WITH INDIGO AND OTHER VAT DYES

BACKGROUND OF THE INVENTION

1. Field of the Invention

This invention relates to a process for dyeing a series of successive garments with a vat dye. The process includes the steps of rapidly impregnating each garment at or near ambient temperature with an aqueous solution of a vat dye and quickly oxidizing essentially all of the vat dye impregnated into the garment. In a preferred embodiment, those two steps of dye impregnation and oxidation occur in less than about ten minutes.

2. Description of the Prior Art

Indigo dye is a type of vat dye that has been known for centuries. Being a vat dye, indigo is normally insoluble in water, but is easily reduced to an amber colored water-soluble form. This soluble form is used to impregnate and dye fibers; subsequent oxidation insolubilizes the dye and produces the final color.

The use of indigo to dye cotton textiles in raw stock, yarn, and fabric forms is well known. See, e.g., U.S. Pat. Nos. 3,457,022; 4,283,194; and 4,342,565; and Canadian Patent No. 1,098,258. These methods are lengthy and consume large amounts of energy by their use of elevated dyeing or oxidation temperatures.

For example, U.S. Pat. No. 3,457,022 describes a process of dyeing cotton yarn wherein indigo is first applied at a temperature of from about 65° to 85° C. The indigo is subsequently oxidized by "skying" the yarn. "Skying", or oxidation by exposure to air, is a lengthy procedure that can take several minutes for yarn lengths and on the order of hours for fabric or garments to produce the final desired color.

U.S. Pat. Nos. 4,283,194 and 4,342,565 disclose a method of dyeing relatively dry cotton yarns and fabrics wherein the indigo dye vat is maintained at a temperature of from about 55° to 90° C. After dyeing, the indigo dye is oxidized by skying or chemically by use of an oxygen donor such as peroxide. No details are given of the chemical oxidation technique.

Canadian Patent No. 1,098,258 discloses a method for dyeing wet cotton yarn. The yarn is passed in sheet form through a wash box so as to treat the yarn with a wetting agent at about 95° C. With a moisture content of about 50% based on the weight of the yarn, the yarn is cooled to about 20° to 25° C. and fed to at least one indigo dye bath maintained at approximately the same temperature as the cooled yarn. The yarn sheet is subsequently conveyed to an oxidizing tank maintained at about 43° C. wherein the indigo dye is fixed in the yarn by a chemical oxidation agent such as sodium bichromate, sodium perborate, hydrogen peroxide, or mixtures thereof. The patent discloses that the preferred speed of the yarn sheet through the system is 50 yard per minutes, or about twice the speed of dyeing yarn in rope form using the skying method of oxidizing.

There are several outstanding advantages to dyeing garments with indigo dye as compared to making garments from indigo-dyed yarns or fabric.

First, dyeing garments provides cost savings based on rapid production rates, low capital outlays, and effective inventory control. Second, dyeing garments provides for ease of operation as the labor intensive steps of warp beam make-up and yarn quilling processes are no longer necessary. Third, dyeing garments more easily achieves the color-coordinated clothing products that result from dyeing garments that contain both knit and woven patterns or that comprise jacquard patterns of different types of yarns.

These and other advantages of the process of the present invention will be apparent from the following detailed description of the invention.

OBJECTS AND SUMMARY OF THE INVENTION

In view of the disadvantages heretofore inherent in vat dyeing textiles in raw stock, yarn, and fabric forms, it is an object of this invention to provide a rapid and inexpensive process for dyeing a series of successive garments with a vat dye, especially indigo dye.

It is also an object of the present invention to provide a process for the rapid and inexpensive dyeing of successive cotton garments with a vat dye, especially indigo dye.

It is a further object of the present invention to provide a process that easily produces color-coordinated clothing products that contain both knit and woven patterns or that comprise jacquard patterns of different types of cellulose fiber yarn.

It is also an object of the present invention to provide a process for the rapid and inexpensive dyeing of successive garments with a vat dye of low substantivity.

The present invention provides a process for dyeing with a vat dye a series of successive garments made of cellulose fiber-containing fabric. The process comprises the steps of (a) supporting the garments in forms so that the garments are open to contact with liquids; (b) placing the supported and successive garments in a spaced adjacent relation on a conveyor means; (c) conveying the supported and successive garments to a first bath such that each garment is immersed at ambient temperature in an aqueous solution comprising a vat dye so as to impregnate or saturate each garment with the aqueous solution of the vat dye; (d) transferring the impregnated garments to a second bath wherein each such garment is immersed at ambient temperature in an aqueous solution comprising an oxidizing agent so as to oxidize essentially all of the vat dye in the garment; (e) transferring the oxidized garments to a water wash system and washing the oxidized garments; and (f) transferring the washed garments to a drying system and drying the washed garments; wherein, during steps (c) and (d), the garments are continuously conveyed at a predetermined rate such that, in step (c), each garment is immersed in the aqueous solution comprising the vat dye for from about one to about five minutes, and, in step (d), essentially all of the vat dye is oxidized in from about two to about ten minutes. In a preferred embodiment, the garments are made from cotton and the vat dye is indigo dye.

DESCRIPTION OF THE DRAWINGS

FIG. 1 is an illustration of stainless steel forms that support shirt-type garments that are to be dyed.

FIG. 3 is an illustration of a stainless steel sleeve insert that is used to support garments that are to be dyed.

DETAILED DESCRIPTION OF THE INVENTION

Figure 2:
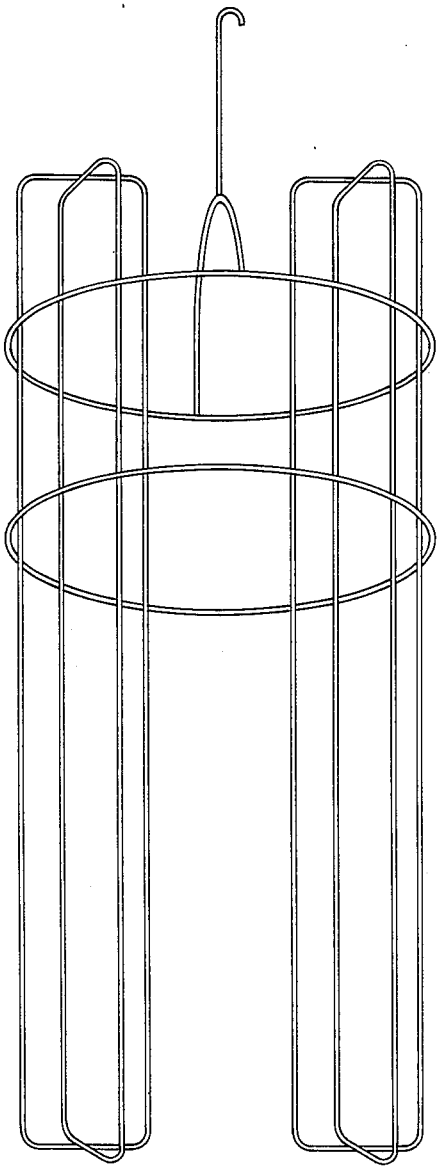
FIG. 2 depicts a stainless steel form that supports pant-type garments that are to be dyed.

The process provided the present invention relates to the dyeing of a series of successive garments with a vat dye.

The process of the present invention will vat dye garments made of fabrics woven or knitted from 100% cotton, cellulose derivatives such as rayon, and blends of cotton with other fibers.

The garments to be dyed may be initially scoured in conventional scour at a temperature up to 100° C., and then washed or rinsed in a series of hot and cold water baths to remove any natural oils and waxes and any additives from prior garment making operations. The scoured garments are then dried to a uniform moisture content equal to or below the normal regain. While garmetns made from greige (unscoured) fabric may be used without any later scour, pre-scouring and pre-shrinking of the fabric prior to manufacturing into garments will prevent unwanted shrinkage in the garment dyeing process as well as enhance dyeing quality. Previous scouring and drying of garments ensures thorough and uniform dyeing. The process is particularly suited to vat dyeing garments made of 100% cotton, but garments constructed of cotton blends and other cellulose derivatives also may be dyed using this technique.

The dye utilized in the present process is a vat dye. A vat dye is a dye that is easily reduced to a soluble and clear form in which it impregnates the garments; subsequent oxidation produces the final color. The vat dyes are well known and include indigo, indanthrone and other forms of indigoid and anthroquinone derivatives. The use of indigo dye is especially preferred.

A particular advantage of the process of the present invention is its ability to dye garments with vat dyes of low substantivity such as indigo. "Substantivity" is the term used in the art for the attraction of a particular dyestuff for a fiber substrate such as a cotton fabric or garment. A low substantivity, for example, the value 3 for indigo dye, indicates a low attraction of the dye for the fiber substrate.

The present process may advantageously use more than one vat dye. In such multi-vat dye processes, the vat dyes can have approximately the same substantivity or substantially different substantivities. In the former case, the successively dyed garments will be of approximately the same shade as each vat dye will be equally attracted to the garments. In the latter instance, successive garments will differ in shade as the vat dye of higher substantivity is more rapidly attracted to each garment than the less substantive dye, and consequently becomes progressively exhausted from the dye bath unless suitable make-up quantities are added. If the same shade is desired throughout a dyeing run, it is well within the ordinary skill in the art to determine empirically the respective amounts of the various individual vat dyes that must be added so that each successive garment is dyed approximately the same desired shade.

The vat dye is used in the present process in the form of an aqueous solution. Preferably, the aqueous solution of the vat dye consists essentially of the vat dye, caustic soda, and hydrosulfite yielding a reduced dye bath. A typical aqueous solution would comprise about 1 to 15 g/l of indigo granules and an appropriate amount of caustic and hydrosulfite to achieve dye reduction, as is otherwise well known. This level of redox potential is maintained at substantially constant level throughout the process. This is preferably accomplished by conventionally monitoring the vat dye concentration by titration or instrumental measurement and continuously recirculating the aqueous dyeing solution. In this manner, garment to garment dyeing control is obtained as additional caustic, hydrosulfite, or vat dye is added as necessary.

The aqueous dyeing solution may further comprise any of the known vat dyeing additives such as surfactants, dispersing agents, lubricants, etc.

To ensure the full and proper exposure of the fabric surfaces of the garments to the aqueous dyeing solution, each garment must be supported on appropriately sized and shaped forms so that the garments are open to contact with liquids. The phrase "open to contact with liquids" is used here to mean that the garments are supported by the forms such that all fabric surfaces of the garments are exposed, inside and outside, to the circulatory liquids in the dyeing and oxidation baths without allowing substantial contact between layers of fabric that form a garment or adjacent garments.

The forms may be constructed from any material that is inert to the dyeing and oxidation baths used in the present process. Stainless steel forms are preferred. Examples of forms that can be used to support shirt-type and pant-type garments are illustrated in FIG. 1 and FIG. 2, respectively.

The supported garments are placed in a successive and spaced adjacent relation on a conveyor means, i.e., they are hung or otherwise placed on a conveyor (such as a cable) one after the other with spacing sufficient to prevent one garment from touching an adjacent garment in the course of the process. In a preferred embodiment, the garments are placed on hanger positions on a conventional conveyor line. Each hanger position can hold one or more garments depending on production requirements.

The conveyor means can be any conventional conveyor system, e.g., an endless belt upon which are placed the hanger positions. The movement of the conveyor and the size of the baths are adjusted such that, at a given conveyor rate, each garment is immersed in each bath for an appropriate length of time. It is within the scope of the present invention to arrange and control the conveyor means and baths in any suitable configuration. For example, the conveyor means may move discontinuously or continuously with the garments appropriately manipulated to achieve the desired immersion times.

The garments are successively conveyed to a first bath that contains the aqueous solution of the vat dye. Each garment, or the garment on each hanger position if more than one garment is placed in a hanger position, is immersed in an aqueous solution at room temperature, i.e., from about 20° C. to about 40° C., for from about one to about five minutes so as to impregnate or saturate each garment with the aqueous dyeing solution.

In preferred embodiments, the garments are immersed in the aqueous dyeing solution for from about one to about four minutes, most preferably, from about one to about two minutes. The particular immersion time can be chosen on the basis of the desired dye shade depth.

After immersion in the aqueous dyeing solution, the garments are transferred to a second bath wherein each garment impregnated with aqueous dyeing solution is immersed at a predetermined temperature in an aqueous solution comprising an oxidizing agent. The oxidizing agent can be any conventional water-soluble agent and is preferably colorless, e.g., one selected from the group consisting of hydrogen peroxide, sodium perborate, and sodium iodate, and mixtures thereof. Oxygen gas may also be used in whole or in part as the oxidizing agent. The predetermined temperature of the aqueous solution of the oxidizing agent may vary from ambient temperature (about 20° to about 25° C.) up to about 60° C. The actual temperature used will depend upon the desired cast or shade of the dyed garments and may be conventionally determined as a matter of course by the skilled artisan. Generally, room temperature to 40° C. is employed. A preferred range when indigo dye is being oxidized is from about 30° to about 40°-50° C. where the cast of the dyed garments will be tinged with red. As with the aqueous dyeing solution, the aqueous solution of the oxidizing agent is conventionally monitored by titration or instrumental measurement to ensure adequate oxidation potential of the solution. Typically, recirculation with the addition of fresh solution is utilized.

The aqueous solution of the oxidizing agent may further comprise sodium carbonate, sodium bicarbonate, acetic acid, or other neutralizing agents. A preferred aqueous solution comprising an oxidizing agent consists essentially of 20 ml/l of 35% aqueous hydrogen peroxide solution and 6 g/l sodium carbonate.

The residence time of the garments in the oxidizing bath is approximately twice that in the aqueous dyeing solution or from about two to about ten minutes, preferably from about two to about six minutes, and most preferably from about two to about five minutes. In each case, the aqueous solution of the oxidizing agent must oxidize substantially all of the vat dye impregnated in the garment. Such oxidation will provide the finished garment with a uniform dyed appearance.

In a preferred embodiment, the total time required for steps (c) and (d) of the process, i.e., immersion in the aqueous solution of the vat dye and the aqueous solution of the oxidizing agent, is less than about ten minutes.

The oxidized garments are then transferred to a water wash system and washed. Any conventional wash system that is able to accommodate garments may be used. A preferred wash system comprises a first room temperature rinse; second rinse of about 25° to 40° C.; third rinse at about 40° C.; and a final soak at from about 80° to about 90° C. The final soak is desirably followed by either exhausting a softener or by a wet-on-wet application of fabric softening agent.

After washing, the garment is transferred to a drying system to be dried.

The following examples are given as specific illustrations of the invention. It should be understood, however, that the invention is not limited to the specific details as set forth in the examples.

EXAMPLE 1

A 200 liter mix of the following aqueous dyeing solution was prepared:

| | |
|---|---|
| Primasol NB-NF* (wetting agent) | 4 g/l |
| Basol WS* (anionic naphthalene condensate dispersing agent) | 2 g/l |
| Basokol NBS* (anionic polymeric organic acid dispersing agent) | 2 g/l |
| Caustic Soda (50% solution) | 12 ml/l |
| Sodium Hydrosulfite | 15 g/l |

-continued

| | |
|---|---|
| Indigo flakes | 5 g/l |
| Water | Balance |

*available from and tradename of BASF Corporation, Paramus, New Jersey

A 200 liter mix of the following aqueous oxidation solution was prepared:

| | |
|---|---|
| Sodium Bicarbonate | 8 g/l |
| $H_2O_2$ (35% solution) | 12 ml/l |
| Water | Balance |

100% cotton sweatshirts were placed on the stainless steel forms depicted in FIG. 1 and successively immersed for 1 minute in the aqueous dyeing solution and 2 minutes in the aqueous oxidation solution, each at room temperature (about 25° C.).

The dyed and oxidized sweatshirts were subsequently subjected to a water wash system that comprised, in succession, a 3-minute cold wash; a 3-minute wash; a 5-minute wash with soap at 60° C.; a 3-minute cold wash; and a 5-minute warm wash with 3 g/l of a conventional cationic silicon softener and 1 ml/l of a 56% solution of acetic acid as finish. The washed garments were then tumble dried.

The appearance of the resulting sweatshirts was an excellent indigo color with full shade coloration and excellent crockfastness.

EXAMPLE 2

A 330 liter mix of the aqueous dyeing solution of Example 1 was prepared. A 330 liter mix of the following aqueous oxidation solution was also prepared:

| | |
|---|---|
| Soda Ash | 6 g/l |
| $H_2O_2$ (35% solution) | 20 ml/l. |

Woven and knitted 100% cotton sweatshirts, and 100% cotton twill jeans, smooth poplin, and corduroy pants were placed on the stainless steel forms depicted in FIG. 1 and FIG. 2, respectively.

The sweatshirts were successively immersed in the aqueous dyeing solution for about 1.5 minutes, and the pants were immersed for about 2 minutes, each at room temperature (about 25° C.). The sweatshirts were successively immersed in the aqueous oxidation solution for about 3 minutes, and the pants were immersed for about 4 minutes, also each at room temperature (about 25° C.).

The dyed and oxidized garments were then washed as described in Example 1 and tumble dried.

As with Example 1, the results were excellent in color depth, color crockfastness, and uniformity of coloration.

EXAMPLE 3

A 200 liter mix of the aqueous dyeing solution of Example 1 was prepared except that 15 ml/l of caustic soda (50% solution) was used and, in place of the indigo flakes, 5 g/l of Palanthrene yellow 5 GF colloidal paste, a yellow vat dye available from BASF Wyandotte Corporation, Parsippany, N.J., was used. The aqueous oxidation solution was a 330 liter mix as used in Example 2.

100% cotton sweatshirts were each placed on a form as depicted in FIG. 1 and were successively immersed in the aqueous dyeing solution for 1 minute, and in the aqueous oxidation solution for approximately 3–4 minutes, all at about 25° C.

The dyed and oxidized garments were then subjected to a water wash system that comprised, in succession, a 3-minute cold wash; a 3-minute warm wash; a 3-minute hot wash; a 10-minute wash with soap at 88° C.; a 3-minute hot wash; and a wash for 5-minutes at 49° C. with the finish described in Example 1. The garments were then tumbled dried.

The substantivity of the yellow vat dye used herein is about 38. This high attraction for the garments resulted in some shade difference in the consecutively finished garments. However, the overall results were again considered to be excellent.

EXAMPLE 4

A 200 liter mix of the aqueous dyeing solution of Example 1 was prepared except that, in place of the indigo flakes, a mixture of 2 g/l of Palathrene green FFB, available from BASF Wyandotte Corporation, Parsippany, N.J., and 0.1 g/l of Verathrene yellow 3GFN-M, available from Mobay Chemical Co. of Rock Hill, S.C., was used. The aqueous oxidation solution was a 200 liter mix as described in Example 2.

Ten 100% cotton sweatshirts were each placed on a form as depicted in FIG. 1 and were successively immersed in the aqueous dyeing solution for about 75 seconds, and in the aqueous oxidation solute for approximately 3–5 minutes, all at about 25° C. The dyed and oxidized garments were washed in the water wash system described in Example 4 and tumble dried.

Because of the different substantivities of the green and yellow vat dyes used, each of the ten resultant garments were a progressively somewhat greener shade. However, the overall results were again considered to be excellent.

Although the invention has been described with preferred embodiments, it is to be understood that variation and modifications may be employed as will be apparent to those skilled in the art. Such variations and modifications are to be considered within the scope of the appended claims.

What is claimed is:

1. A process for dyeing a series of successive garments with a vat dye, comprising the steps of:
   (a) supporting the garments on forms such that all fabric surfaces of each garment are open to contact with liquids;
   (b) placing the supported and successive garments in a spaced adjacent relation on a conveyor means;
   (c) conveying the supported and successive garments to a first bath such that each garment is immersed therein at ambient temperature in an aqueous dyeing solution comprising a vat dye until each garment is uniformly impregnated with the aqueous dyeing solution of the vat dye;
   (d) transferring the supported, impregnated garments to a second bath wherein each garment is immersed at a predetermined temperature in an aqueous solution comprising an oxidizing agent so as to uniformly oxidize substantially all of the vat dye in the garment;
   (e) transferring the oxidized garments to a water wash system and washing the oxidized garments; and
   (f) transferring the washed garments to a drying system and drying the washed garments;

wherein, during steps (c) and (d), the garments are conveyed at a predetermined rate such that, in step (c) each garment is immersed in the aqueous solution comprising the vat dye for from about one to about five minutes, and in step (d), each garment is immersed in the oxidizing bath for from about two to about ten minutes.

2. The process of claim 1 wherein the vat dye is selected from the group consisting of indigo, anthraquinone and derivatives thereof.

3. The process of claim 1 wherein the oxidizing agent is selected from the group consisting of hydrogen peroxide, sodium perborate, oxygen, sodium iodate, and mixtures thereof.

4. The process of claim 1 wherein each garment is immersed in the aqueous solution comprising the vat dye for from about one to about four minutes.

5. The process of claim 1 wherein each garment is immersed in the aqueous solution comprising the vat dye for from about one to about two minutes.

6. The process of claim 5 wherein each garment is immersed in the oxidizing bath for from about two to about six minutes.

7. The process of claim 1 wherein each garment is immersed in the oxidizing bath for from about two to about five minutes.

8. The process of claim 1 wherein the total time required for steps (c) and (d) is less than about ten minutes.

9. The process of claim 1 wherein said predetermined temperature is from about 25° to about 60° C.

10. The process of claim 1 wherein said predetermined temperature is from about 30° to about 50° C.

11. The process of claim 1 wherein said predetermined temperature is ambient temperature.

12. A process for indigo dyeing a series of successive cotton garments, comprising the steps of:
   (a) supporting the garments on forms such that all fabric surfaces of the garments are open to contact with liquids:
   (b) placing the supported and successive garments in a spaced adjacent relation on a conveyor means;
   (c) conveying the supported and successive garments to a first bath such that each each garment is immersed at ambient temperature in an aqueous dyeing solution comprising indigo dye until each garment is uniformly saturated with the aqueous dyeing solution;
   (d) transferring the supported garments to a second bath in which each garment is immersed at a predetermined temperature in an aqueous solution comprising an oxidizing agent until substantially all of the indigo dye in the garment is uniformly oxidized;
   (e) transferring the oxidized garments to a water wash system and washing the oxidized garments; and
   (f) transferring the washed garments to a drying system and drying the washed garments;

wherein, during steps (c) and (d), the garments are conveyed at a predetermined rate such that, in step (c), each garment is immersed in the aqueous solution comprising indigo dye for from about one to about five minutes and, in step (d), each garment is immersed in the oxidizing bath for from about two to about ten minutes.

13. The process of claim 12 wherein the aqueous dyeing solution consists essentially of indigo dye, caustic soda, and hydrosulfite.

14. The process of claim 12 wherein the oxidizing agent is selected from the group conisting of hydrogen peroxide, sodium perborate, oxygen, sodium iodate, and mixtures thereof.

15. The process of claim 12 wherein said predetermined temperature is from about 25° to about 60° C.

16. The process of claim 12 wherein said predetermined temperature is from about 30° to about 50° C.

17. The process of claim 12 wherein said predetermined temperature is ambient temperature.

18. A process for indigo dyeing a series of successive cotton garments, comprising the steps of:

(a) supporting the garments on forms such that all fabric surfaces of the garments are open to contact with liqulds;

(b) placing the supported and successive garments in a spaced adjacent relation on a conveyor means;

(c) conveying the supported and successive garments to a first bath and immersing each garment therein at room temperature in an aqueous dyeing solution consisting essentially of indigo dye, caustic soda, and hydrosulfite until each garment is uniformly impregnated with the aqueous dyeing solution;

(d) transferring the supported garments to a second bath in which each garment is immersed at a predetermined temperature in an aqueous solution consisting essentially of from about 5 to about 30 ml/l of hydrogen peroxide and from about 1 to about 10 g/l of sodium carbonate until substantially all of the indigo dye in the garment is uniformly oxidized;

(e) transferring the oxidized garments to a water wash system and washing the oxidized garments;

(f) transferring the washed garments to a drying system and drying the washed garments;

wherein, during steps (c) and (d), the garments are continuously conveyed at a predetermined rate such that, in step (c), each garment is immersed in indigo dye solution for from about one to about two minutes and, in step (d), each garment is immersed in oxidizing solution for from about two to about five minutes.

19. The process of claim 18 wherein said predetermined temperature is from about 25° to about 60° C.

20. The process of claim 18 wherein said predetermined temperature is from about 30° to about 50° C.

21. The process of claim 18 wherein said predetermined temperature is ambient temperature.

* * * * *